US008151375B2

(12) United States Patent
Taccioli et al.

(10) Patent No.: US 8,151,375 B2
(45) Date of Patent: Apr. 10, 2012

(54) MECHANISM FOR ASSEMBLY AND DISASSEMBLY OF HELMET VISORS

(75) Inventors: Emiliano Taccioli, Sesto s. Giovanni (IT); Filippo Carlo Ratti, Villalvernia (IT)

(73) Assignee: Mat Global Solutions, S.L., Terrassa (ES)

( * ) Notice: Subject to any disclaimer, the term of this patent is extended or adjusted under 35 U.S.C. 154(b) by 691 days.

(21) Appl. No.: 12/293,227

(22) PCT Filed: Apr. 2, 2007

(86) PCT No.: PCT/EP2007/002926

§ 371 (c)(1),
(2), (4) Date: Jan. 12, 2009

(87) PCT Pub. No.: WO2007/112990

PCT Pub. Date: Oct. 11, 2007

(65) Prior Publication Data

US 2009/0126086 A1 May 21, 2009

(30) Foreign Application Priority Data

Apr. 4, 2006 (IT) ..... MI2006A0663

(51) Int. Cl.
*A42B 3/22* (2006.01)

(52) U.S. Cl. ..... 2/429; 3/425; 3/410; 3/424

(58) Field of Classification Search ..... 2/424, 9, 2/425, 410, 429

See application file for complete search history.

(56) References Cited

U.S. PATENT DOCUMENTS

| | | | | | |
|---|---|---|---|---|---|
| 3,491,372 | A * | 1/1970 | Aileo | 2/9 |
| 4,866,792 | A | 9/1989 | Arai | |
| 4,907,299 | A | 3/1990 | Arai | |
| 5,062,162 | A * | 11/1991 | Kamata | 2/424 |
| 5,091,997 | A * | 3/1992 | Foehl | 2/424 |
| 5,333,329 | A * | 8/1994 | Hong | 2/424 |
| 5,461,731 | A * | 10/1995 | Shida | 2/424 |
| 5,901,369 | A * | 5/1999 | Pilney | 2/6.5 |
| 6,260,213 | B1 | 7/2001 | Eom et al. | |
| 6,264,392 | B1 * | 7/2001 | Wise et al. | 403/112 |
| 6,557,185 | B1 * | 5/2003 | Lee | 2/424 |
| 6,622,313 | B1 * | 9/2003 | Choi et al. | 2/424 |
| 6,622,314 | B1 * | 9/2003 | Kim et al. | 2/424 |
| 6,842,913 | B1 * | 1/2005 | Song | 2/424 |
| 6,851,129 | B2 * | 2/2005 | Gafforio et al. | 2/424 |
| 7,181,777 | B2 * | 2/2007 | Choi et al. | 2/424 |
| 2006/0117467 | A1 | 6/2006 | Choi et al. | |

FOREIGN PATENT DOCUMENTS

| | | |
|---|---|---|
| EP | 1 661 474 A1 | 5/2006 |
| KR | 100 568 946 A | 4/2006 |

* cited by examiner

*Primary Examiner* — Brian D Nash
(74) *Attorney, Agent, or Firm* — Sughrue Mion, PLLC

(57) ABSTRACT

Device for assembly and disassembly of protective helmet visors, such visor being of the type presenting a hinge inwards the inner visor face, one on each visor extreme. The device includes a base component developed to be robustly linked to the protective helmet and a first recess developed to consent the insertion of the visor hinge into such recess. It also includes blocking components interacting with the hinge. At the same time the lever, inserted into the base, has a relative movement with respect to the base between the visor blocking position and visor opening position.

12 Claims, 3 Drawing Sheets

MECHANISM FOR ASSEMBLY AND DISASSEMBLY OF HELMET VISORS

FIELD OF INVENTION

The present invention is about an improved device for assembling and disassembling of protective helmet visors.

BACKGROUND

As known, the protective helmets, for example for motorcyclist, basically include a Shell developed to protect the users head from accidental crashes, and a transparent component named "Visor" that offers a high degree of protection to face without limiting vision and/or the field of vision. In particular, the visor protects the user eyes, both in a crash and from rain, from insects, dust and any other external body that could impact the users face during driving. Obviously, the Shell that protects user eyes, is exposed to such external bodies impact, including also small stones of variable dimensions that could be expelled by other vehicle wheels or, in case of off-road driving, small stones coming from the road itself or rocky walls along the road.

For all the above reasons, and many other that might occur during normal driving, the Visor is a component exposed to crash. To be considered also that in relatively short period of time, the Visor must be replaced by a new one, to ensure a good vision to users.

At the same time, in the last years, it have been developed a large variety of visor types. At the beginning, it was only available clear visors. At present, it is possible to find in the market visors with anti-fog treatments, typically for winter use. It is also possible to finding in the market tinted visors, typically for summer use, that filters sun light with equal quality to any other solar lens.

Therefore, it is clear the users need to replace the Visor, not only when the Visor gets damaged but also to clean it, and/or to replace the Visor following the season and according to season, weather and any other conditions and/or considerations of normal helmet use.

The Visor, that usually is connected to the Shell by a linking device that allows Visor opening and close according to user needs, at the same time needs to be easily replaced, in a quick manner and preferably without auxiliary tools. At the same time, it's extremely important that the Visor assembly operation be user friendly, secure and "error-free", in such a way that prevents accidental detachment after assembly.

Well known helmets presents Visor assembly/disassembly systems including a base component fixed to the Shell and a cover that covers the Visor extreme and the assembly device, offering both a protective function an aesthetical function.

These well known devices present also a list of disadvantages.

A first inconvenient is the fact that such assembly devices are of complex realisation, this both from the product development point of view or from the assembly point of view. This adds complexity for the final user during the normal and daily use of the helmets and visors.

Another inconvenient is the fact that the Visor must be hardly pulled to be disassembled from the connecting devices used to link the Visor to the Shell. For the same reasons, the Visor must be hardly pushed to be assembled into the connecting devices. These all highly increase the risk of damaging the connecting devices, the visor itself and increase the risk to scratch the shell.

NON-LIMITING OBJECTS OF THE INVENTION

The targets and objectives of the present invention is such to present a helmet Visor assembly device that improves and resolves the disadvantages not resolved by other well known devices.

Within the field of these targets, one scope of the present invention is to offer a Visor assembly device of simple realisation and assembly.

Another scope of the present invention is to offer a friendly user Visor assembly device, both for the Visor disassembly operation and for the insertion of the Visor by the user.

Another scope of the present invention is to offer more robust Visor assembly device compare to other well know devices.

Another one scope of the present invention is to develop a Visor assembly device completely protected by the abrasion and degradation caused by external bodies such dust, water and any other thing that will compromise the proper functioning of the device.

The above scope and others that will be better explained in the present document, can be achieved by a helmet Visor assembly device, such Visor including a hinge on both extremities, such device including a base component developed to be robustly linked to the protective helmet and a first recess developed to consent the insertion of the visor hinge into such recess. Such Visor assembly device includes blocking components interacting with the hinge. At the same time the lever, inserted into the base, has a relative movement with respect to the base between the visor blocking position and visor opening position.

BRIEF DESCRIPTION OF THE FIGURES

Other characteristics and advantages of the present invention are better explained in the following detailed description, presented in a descriptive way and not limitative and illustrated in the annexed figures, in which.

DETAILED DESCRIPTION OF NON-LIMITING EMBODIMENTS

Figure 4:
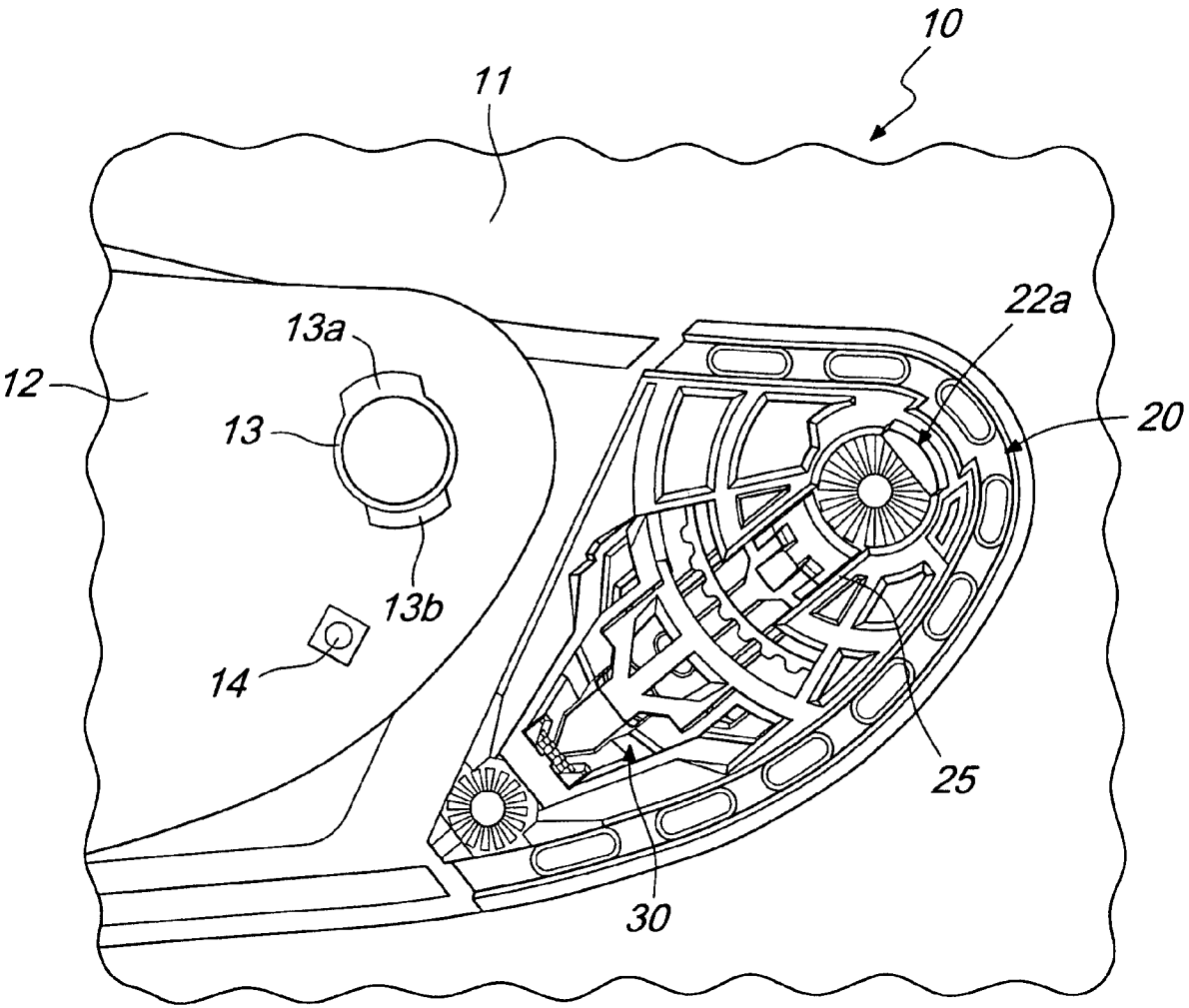
FIG. 4 shows some Visor details adapted for the insertion into the device developed following the present invention. It also shows the device itself assembled to a helmet.

Following one of the preferred shapes of the device developed according to the present invention, the device (20) presents a base component (21) that consents the insertion of the blocking device (30) into a recess (25). As shown in FIG. 4, the base component (21) of the assembly device (20) can be robustly fixed to the helmet Shell (11). The visor extremes (12) can be assembled to the base component (21).

For this purpose, the base component (21) includes a first recess (22) that allows the Visor (12) insertion. The first recess (22) in the realisation form illustrated shows basically a circular profile that allows the insertion of the Visor extreme hinge (13), as shown in FIG. 4. The first recess (22) has another opening (22*a*) located diametrically opposite to the recess for the blocking components.

The hinge (13) has a profile adapted to consent the insertion and link between the Visor (12) and the first recess (22) of the base component (21). At the same time shows a profile to interfere with the blocking device (30) to consent the blocking between the Visor (12) and the assembling device developed following the present invention. More in detail, the hinge (13) shows, in the realisation form illustrated, basically a circular profile with two teeth, a first tooth (13*a*) and a second tooth (13*b*), oriented outwards with respect to the hinge (13) circular profile and located diametrically opposite.

When the two teeth (13*a*) and (13*b*) are aligned with respect to the opening (22*a*) and the recess (25) of the blocking device (30), the hinge (13) can be inserted in the first recess (22), after moving the blocking device (30) to the assembly position.

The blocking device includes a lever (30) with a studied shape to be positioned into the recess (25) of the base component (21), in such a way that the lever edge (31) is aligned with the first recess (22).

The lever edge (31) has a profile (31*a*) to interfere with the tooth (13*b*) when the hinge (13) is in the insertion position with the teeth (13*a*) and (13*b*) aligned respectively with the opening (22*a*) and with the lever edge (31). More in detail, the lever (30) is located in the recess (25) linked with the base component (21) in a way that consents lever displacement between two positions. A first Visor blocking position, as shown in FIG. 2, and second Visor disassembling position, as shown in FIG. 2*a*.

An elastic spring (40), located between the base component (21) and the lever (30), works over the lever (30) keeping it in the blocking position or pushing the lever to close into the Visor blocking position as shown in FIG. 2. In this Visor blocking position the lever edge profile (31*a*) of the lever (30) interferes with the tooth (13*b*).

Figure 3:
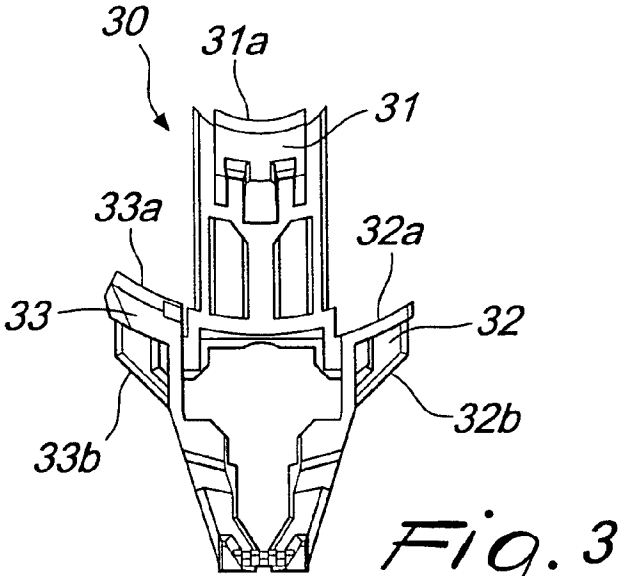
FIG. 3 shows a lever of the blocking components of the assembly device shown in FIGS. 1 and 2.
Figure 5:
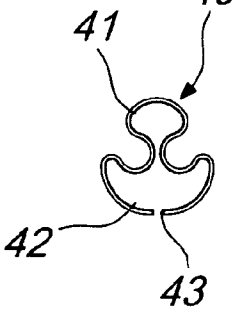
FIG. 5 shows an example of one of the possible shapes for the spring included in the blocking components developed following the present invention.
Figure 1:
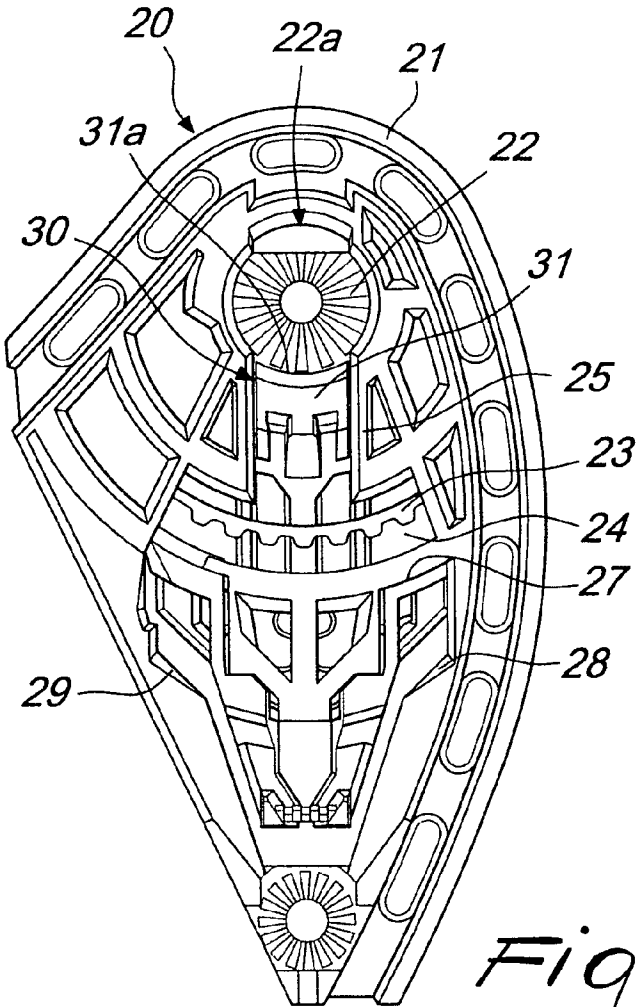
FIG. 1 illustrates a front view of the Visor assembly device following the present invention.

FIG. 5 shows in detail the spring (40). Following one of the preferred developments shown in this document, the spring (40) can be a preformed shape of plastic materials. The shape of such spring, that can be preferably developed in plastic materials but it could be developed with any other material like for example rubber, gives the spring strength by deformation. When a force is applied to the spring by compression, as shown in FIG. 2*a*, generates a force in the opposite direction proportional to the spring elastic modulus and to the deformation. When the spring (40) is located between the base component (21) and the blocking device (30), the spring base surface (42) contacts in a stable mode the spring base component recess (26). The spring top surface (41) contacts in a stable mode the lever (30).

The spring base surface (42) can also present other ways to improve the assembly to the base component (21), for example a channel (43) to be aligned and inserted with the insertion rib (26*a*) in the spring base component recess (26). The lever stroke between the blocking position and the disassembling position by the lever (30) shape that has one or more stoppers (32), (33) developed to face each the corresponding base component stoppers 27, 28, 29 of the base component (21). More in detail, the stoppers (32) and (33) have each a top surface (32*a*) and (33*a*) to define and limit the lever (30) stroke during the spring (40) expansion towards the Visor closing position. The stoppers (32) and (33) have also a lower surface (32*b*) and (33*b*) to define and limit the lever (30) stroke during the spring (40) compression towards the Visor disassembly position. The lever (30) movement direction is defined and limited the recess (25) shape in the base component (21).

The base component (21) has also a guidance (24) developed to insert the second Visor hinge (14) located in the inner face of the Visor extreme (12), as shown in FIG. 4. The guidance (14) shows basically a circular profile, and at list one of the faces of the guidance has teeth in relief or a teeth profile (23).

The disassembling function of the present invention works in the following way,

The Visor (12) is linked to the Shell (11) through the assembling device (20). The link between the Visor (12) and the Shell (11) is made between the first Visor hinge (13) inserted into the recess (22). The hinge's teeth (13*a*) and (13*b*) interfere with the recess (22) perimeter. This interference blocks the first Visor hinge (13) into the recess (22). When the visor is properly positioned for disassembling operation, for example in the visor open position, the teeth (13*a*) and (13*b*) are aligned respectively with the opening (22*a*) and with the lever edge profile (31*a*). In this position, the first Visor hinge (13) is fixed to the recess (22) only by the lever edge profile (31*a*) that interferes with the teeth (13*b*). The spring (40) force keeps the lever (30) into the blocking position, blocking the first Visor hinge (13) into the recess, except in case the user pulls intentionally the lever (30).

Figure 2B:
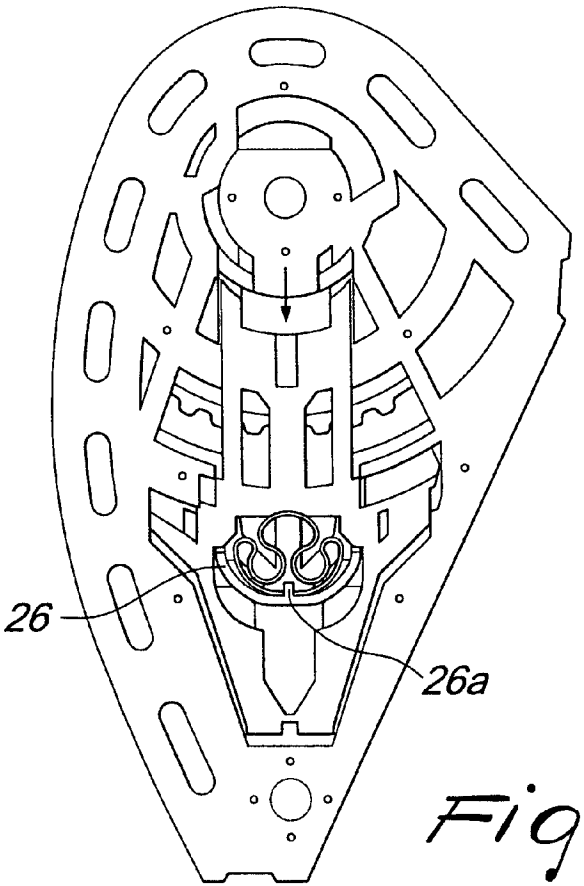
FIG. 2*b* illustrates the rear view in which the blocking components are in the Visor disassembly position.
Figure 2A:
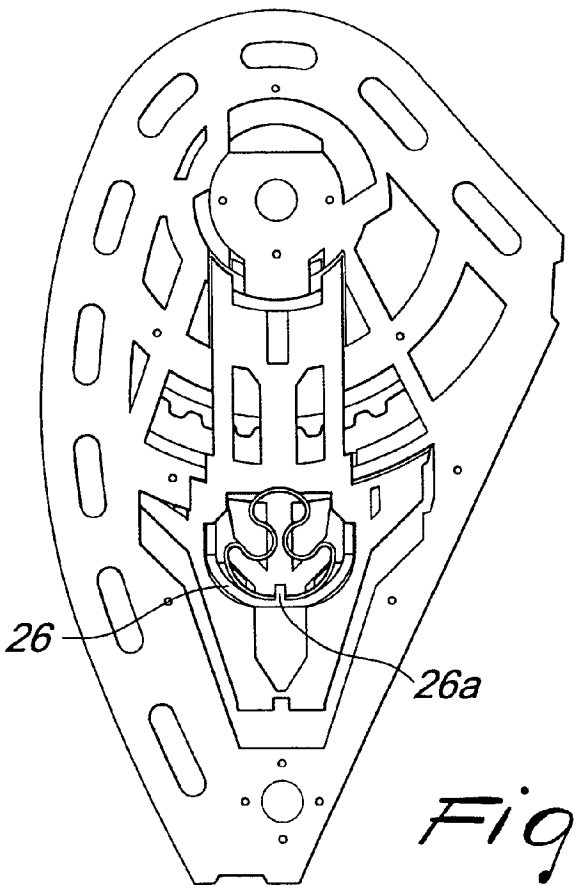
FIG. 2*a* illustrates a rear view of the Visor assembly device following the present invention, in which the blocking components are in the Visor blocking position.

With the first Visor hinge (13) in this position, the user can pulls the lever (30) to move it from the blocking position shown in FIG. 2*a* to the disassembling position shown in FIG. 2*b*. In this lever (30) position the first Visor hinge (13) can be freely removed from the recess (22) and the Visor (12) can be removed.

With the Visor assembled to the helmet, the second Visor hinge (14) inserted into the guidance (24) can slide through the guidance into discrete positions defined by the amplitude of the teeth profile step (23). Thanks to the connection between the second Visor hinge (14) and the guidance (24), the Visor can be positioned and therefore opened in several positions, according to the user needs. The guidance (24) has a circular profile that follows the circular trajectory described by the second Visor teeth (14) during the Visor opening and closing operations, rotating with respect to the axis of the first Visor hinge (13).

When the Visor must be inserted again in the helmet, the Visor must be again located in the same position that allows the disassembling operation, for example in the completely open position. In this position, as explained before, the first tooth (13*a*) and the second tooth (13*b*) are aligned respectively with the first recess opening (22*a*) and with the lever edge profile (31*a*) of the lever (30).

Then, in order to assemble the Visor to the Shell, the user only need to act on the lever (30) pulling manually the lever from the blocking position to the assembling position, in opposition to the spring (40) force. This way the lever edge (31) has been displaced enough to give space for the tooth (13*b*) insertion, while the teeth (13*a*) is immediately inserted in the opening (22*a*) and therefore the first Visor hinge gets into the base component recess (22). When the user releases the lever (30), the spring (40) force push the lever onto the blocking position shown in FIG. 2*a*, blocking the first Visor hinge (13) into the base component recess (22). Visor closing operation disaligns teeth (13*a*) and (13*b*) from the opening (22*a*) and from the lever edge profile (31*a*). Visor closing operation forces the teeth (13*a*) and (13*b*) to interfere with the recess (22) profile, and guarantees the Visor (12) fixation to the Shell. In fact, in any other Visor position except the disassembling position, the teeth (13*a*) and (13*b*) are not aligned with the first recess opening (22*a*) and with the lever edge profile (31*a*), preventing accidental Visor disassembling.

When the visor is not in the disassembling position, therefore in the standard conditions of use, the blocking device (30) is not accessible. This also helps to prevent accidental Visor disassembling.

It has been proven how the present device full fills the main targets and the above proposed scopes. In particular, it has been illustrated how the mechanism for assembly and disassembly of helmet visors following the present invention is friendly use device during the operations of assembly and disassembly.

On the other hand, the device developed following the present invention, combines the simplicity of construction and the user friendly concept with a extremely secure fixation of the Visor to the helmet.

Another scope achieved by the device developed following the present invention is the fact that the device itself is completely protected when the Visor is in close position. This way the device is more robust and durable.

A large number of modifications and versions can be developed by sector experts but within the protection of the present invention.

Therefore, the protection scope of claims can not be limited by the illustrations or by the preferred developments shown in the descriptions in its form of examples. The claims must include all innovative characteristics that can be patented, derived from the present invention, including all characteristics that can be considered similar by sector experts and technicians.

The invention claimed is:

1. A visor assembly for a protective helmet, the visor assembly comprising:

a visor comprising extremities, each extremity comprising a visor hinge on an inner surface of the extremity and oriented inwards;

a base component configured to be fixed to a protective helmet, the base component comprising a blocking device recess and a first recess, the first recess configured to receive the visor hinge inserted in the first recess;

a blocking device configured to interact with the visor hinge and located in the blocking device recess, the blocking device relatively movable with respect to the base component between a visor blocking position and a visor disassembling position;

the blocking device comprising a lever with a lever edge that in the visor blocking position interferes with the visor hinge and blocks the visor in the first recess, the lever is pushed by a spring to place the blocking device in the visor blocking position, the spring interacting with the lever and the base component.

2. The assembly of claim 1, wherein the lever includes one or more stoppers, each adapted to face a corresponding base component stopper of the base component, so that the lever strokes between the visor blocking position and the visor disassembling position.

3. The assembly of claim 1, wherein the lever edge, in the visor blocking position interferes with a tooth oriented outwards from the visor hinge.

4. The assembly of claim 1, wherein the first recess includes at least one opening adapted to insert a tooth oriented outwards from the hinge.

5. The assembly of claim 4, wherein the opening is located diametrically opposite to the lever edge.

6. The assembly of claim 1, wherein the spring is a preformed component with increase elasticity given the shape itself.

7. The assembly of claim 6, wherein spring is a ring of irregular shape, with one or more cavities.

8. The assembly of claim 7, wherein spring has a symmetrical profile with respect to a plane of symmetry.

9. The assembly of claim 1, comprising a second recess with a generally circular profile, and at least one inner face of the second recess including a toothed profile.

10. A protective helmet visor assembly, comprising:

a visor comprising extremities, each extremity comprising a visor hinge on an inner surface of the extremity and oriented inwards;

a base component configured to be fixed to a protective helmet, the base component comprising a blocking device recess and a first recess configured to receive the visor hinge inserted in the first recess;

a blocking device configured to interact with the visor hinge and located in the blocking device recess, the blocking device relatively movable with respect to the base component between a visor blocking position and a visor disassembling position;

the blocking device comprising a lever with a lever edge that in the visor blocking position interferes with the visor hinge and blocks the visor in the first recess;

wherein the lever includes one or more stoppers, each adapted to face a corresponding base component stopper of the base component, so that the lever strokes between the visor blocking position and the visor disassembling position;

wherein the hinge comprises a first tooth and a second tooth that are located at points diametrically opposed in the hinge profile;

wherein the first recess comprises an opening, the opening and the lever located at points diametrically opposed with respect to the first recess so that the first tooth and second tooth can be aligned with the opening and the lever; and wherein, when the first tooth is aligned with the opening, the second tooth is aligned with the lever edge and the lever is in the visor blocking position, the hinge is fixed into the first recess by interaction between the lever and the second tooth.

11. The assembly of claim 10, wherein when the first tooth is aligned with the opening and such second tooth is aligned with such lever edge, the hinge can be freely removed from the first recess by pulling such the lever.

12. A protective helmet comprising the assembly of claim 1.

* * * * *